US009840094B2

(12) United States Patent
Mori et al.

(10) Patent No.: US 9,840,094 B2
(45) Date of Patent: Dec. 12, 2017

(54) BOBBIN FOR THERMAL TRANSFER SHEET OR IMAGE-RECEIVING SHEET, ASSEMBLY OF BOBBIN AND SHEET, AND THERMAL TRANSFER PRINTER

(71) Applicant: Dai Nippon Printing Co., Ltd., Tokyo (JP)

(72) Inventors: Shigeta Mori, Tokyo (JP); Munenori Ieshige, Tokyo (JP); Akira Takahashi, Tokyo (JP); Yuichi Taguchi, Tokyo (JP)

(73) Assignee: Dai Nippon Printing Co., Ltd., Shinjuku-Ku (JP)

( * ) Notice: Subject to any disclaimer, the term of this patent is extended or adjusted under 35 U.S.C. 154(b) by 0 days.

(21) Appl. No.: 15/308,515

(22) PCT Filed: May 27, 2015

(86) PCT No.: PCT/JP2015/065289
§ 371 (c)(1),
(2) Date: Nov. 2, 2016

(87) PCT Pub. No.: WO2015/182672
PCT Pub. Date: Dec. 3, 2015

(65) Prior Publication Data

US 2017/0080724 A1 Mar. 23, 2017

(30) Foreign Application Priority Data

May 29, 2014 (JP) ..... 2014-111613

(51) Int. Cl.
*B41J 11/04* (2006.01)
*B41J 2/325* (2006.01)
(Continued)

(52) U.S. Cl.
CPC ..... *B41J 11/04* (2013.01); *B41J 2/325* (2013.01); *B41J 17/02* (2013.01); *B41J 17/24* (2013.01);
(Continued)

(58) Field of Classification Search
CPC ..... B41J 25/304; B41J 25/312; B41J 25/316; B41J 25/308; B41J 25/3082;
(Continued)

(56) References Cited

U.S. PATENT DOCUMENTS 6,457,885 B1 10/2002 Yamamoto et al.

FOREIGN PATENT DOCUMENTS

JP 10-129067 A1 5/1998
JP 2000-120715 A1 4/2000
(Continued)

OTHER PUBLICATIONS

International Search Report and Written Opinion (Application No. PCT/JP2015/065289) dated Jun. 30, 2015.
(Continued)

*Primary Examiner* — Kristal Feggins
(74) *Attorney, Agent, or Firm* — Burr & Brown, PLLC

(57) ABSTRACT

There is provided a bobbin for a thermal transfer sheet or an image-receiving sheet which can reduce the number of parts and can have a smooth surface. The bobbin includes a cylindrical bobbin body 11. A gear 12 including a number of teeth 13 is formed in one end surface of the bobbin body 11. The teeth 13 of the gear 12 each have the shape of a trapezoid when viewed from the side. One lateral side **13*b* of the trapezoid extends in the axial direction of the bobbin body 11**.

7 Claims, 7 Drawing Sheets

(51) Int. Cl.

| | |
|---|---|
| ***B41J 17/02*** | (2006.01) |
| ***B41J 17/24*** | (2006.01) |
| ***B41J 17/32*** | (2006.01) |
| ***B65H 75/10*** | (2006.01) |
| ***B65H 75/18*** | (2006.01) |

(52) U.S. Cl.
CPC ..... *B41J 17/32* (2013.01); *B65H 75/10* (2013.01); *B65H 75/18* (2013.01)

(58) Field of Classification Search
CPC ..... B41J 25/3084; B41J 25/3086; B41J 25/3088; B41J 29/026; B41J 29/023; B41J 29/02; B41J 29/00; B41J 15/044; B41J 3/4075; B41J 32/00
See application file for complete search history.

(56) References Cited

FOREIGN PATENT DOCUMENTS

| | | | |
|---|---|---|---|
| JP | 2001-122523 | A1 | 5/2001 |
| JP | 2001-150775 | A1 | 6/2001 |
| JP | 2006-315273 | A1 | 11/2006 |

OTHER PUBLICATIONS

English translation of International Preliminary Report on Patentability (Application No. PCT/JP2015/065289) dated Nov. 29, 2016.
Japanese Office Action (Application No. 2014-111613) dated Sep. 5, 2017 (with English translation).

BOBBIN FOR THERMAL TRANSFER SHEET OR IMAGE-RECEIVING SHEET, ASSEMBLY OF BOBBIN AND SHEET, AND THERMAL TRANSFER PRINTER

TECHNICAL FIELD

The present invention relates to a bobbin for a thermal transfer sheet or an image-receiving sheet, an assembly of a bobbin and a sheet, and a thermal transfer printer.

BACKGROUND ART

Thermal transfer printers are widely prevalent which print characters or images on an object, such as an image-receiving sheet, by using an ink ribbon (thermal transfer sheet). The ink ribbon includes a ribbon (support layer) extending in a strip shape, and an ink layer containing a dye, etc. and formed on the ribbon. The ink ribbon is mounted and wound on a bobbin.

The bobbin, on which the ink ribbon is wound, generally includes a bobbin body and a driving flange mounted to the bobbin body as a separate member from the bobbin body.

However, the provision of such a driving flange, as a separate member, in a bobbin body increases the number of structural parts and increases the production cost and, in addition, involves a cumbersome operation when disposing of the bobbin.

It is conceivable to form driving irregularities in the outer surface of a bobbin body. However, when winding a ribbon on the bobbin, a rubber touch roll pressing on the ribbon can make contact with the driving irregularities, resulting in the formation of scratches on the touch roll.

PRIOR ART DOCUMENTS

Patent Documents

Patent document 1: Japanese Patent Laid-Open Publication No. 2001-122523

Patent document 2: Japanese Patent Laid-Open Publication No. 2001-150775

SUMMARY OF THE INVENTION

Problems to be Solved by the Invention

The present invention has been made in view of the above situation. It is therefore an object of the present invention to provide a bobbin for a thermal transfer sheet or an image-receiving sheet, an assembly of a bobbin and a sheet, and a thermal transfer printer which can reduce the number of structural parts and can avoid scratching on a touch roller.

Means for Solving the Problems

The present invention provides a bobbin for a thermal transfer sheet or an image-receiving sheet, comprising a cylindrical bobbin body, wherein a gear including a number of teeth is formed in one end surface of the bobbin body, and wherein when the bobbin body is viewed from the side, the teeth each have the shape of a trapezoid composed of an upper base, a lower base, and a pair of lateral sides, one of the lateral sides extending parallel to the axis of the bobbin body.

In a preferred embodiment of the present invention, the sum of the circumferential lengths of the tooth tops of the teeth is 20% to 70% of the circumferential length of the bobbin body.

In a preferred embodiment of the present invention, the bobbin body is provided with a circumferential groove or a circumferential projection which performs positioning of the bobbin body when setting it in a case.

In a preferred embodiment of the present invention, the bobbin body is provided, in the other end surface, with an engagement groove which performs positioning of a flange when mounting it to the bobbin body.

The present invention also provides an assembly of a bobbin and a sheet, comprising: the above-described bobbin for a thermal transfer sheet or an image-receiving sheet; and a thermal transfer sheet or an image-receiving sheet wound on the bobbin.

In a preferred embodiment of the present invention, the assembly of a bobbin and a sheet further comprises a case for housing the bobbin and the thermal transfer sheet or the image-receiving sheet.

The present invention also provides a thermal transfer printer incorporating the above-described assembly of a bobbin and a sheet, comprising: a mounting section in which the assembly of a bobbin and a sheet is to be set; and a drive section including a drive shaft extending coaxially with the bobbin body, wherein a drive gear that engages the gear of the bobbin body is provided in an end surface of the drive shaft.

Advantageous Effects of the Invention

The present invention makes it possible to reduce the number of structural parts and, in addition, to provide a bobbin body having a smooth surface without any driving irregularities.

DESCRIPTION OF THE PREFERRED EMBODIMENTS

Embodiment

An embodiment of the present invention will now be described with reference to the drawings.

FIGS. 1 through 8 are diagrams illustrating the embodiment of the present invention.

Figure 1:
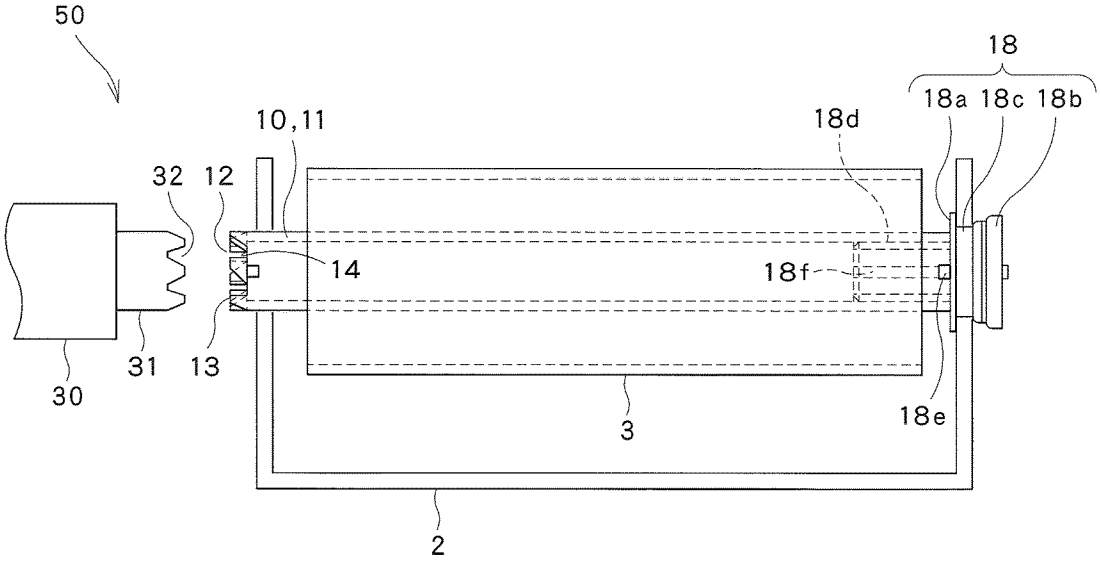
FIG. 1 is a side view of a bobbin for a thermal transfer sheet or an image-receiving sheet according to the present invention.
Figure 2:
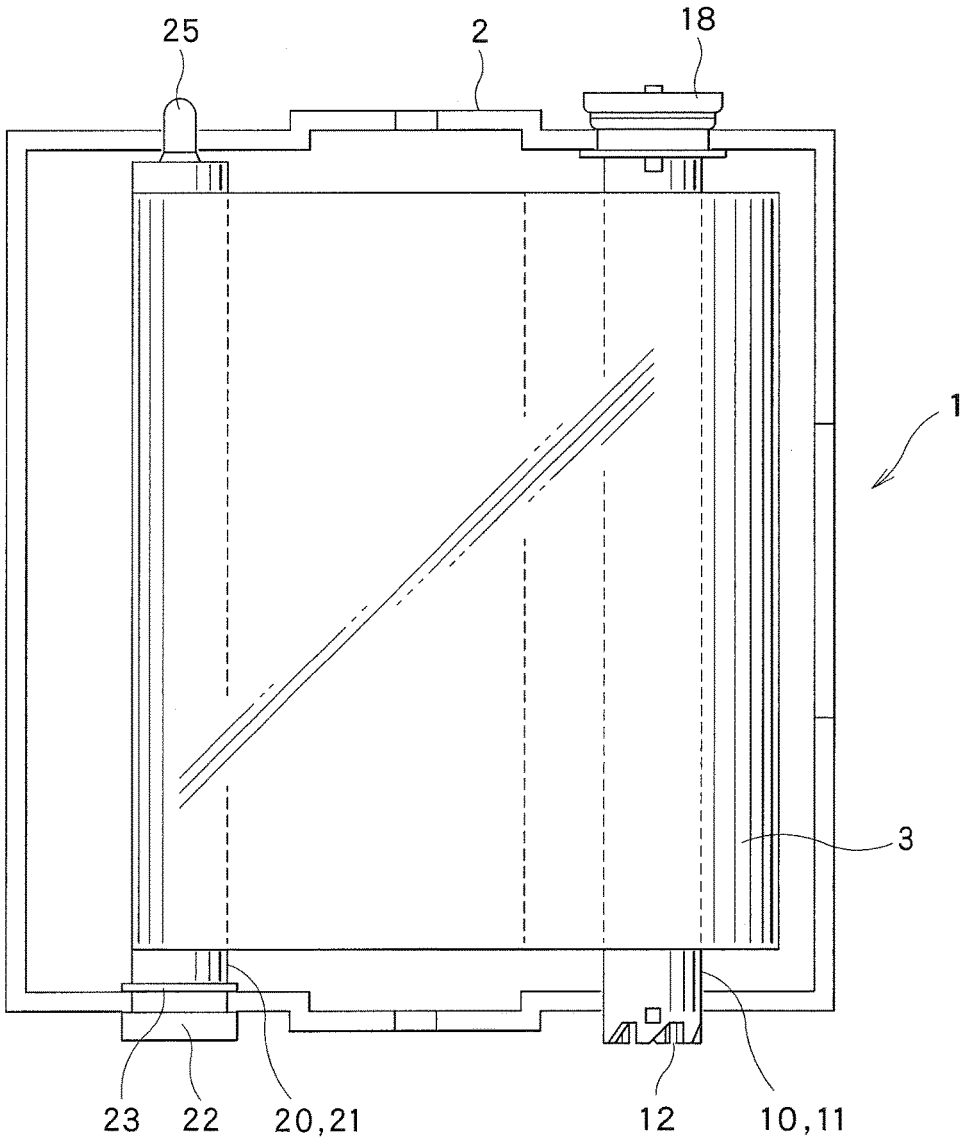
FIG. 2 is a plan view of an assembly of a sheet and bobbins.

At the outset, a ribbon cartridge (assembly of bobbins and a sheet) 1 incorporating a bobbin 10 for a thermal transfer sheet or an image-receiving sheet according to the present invention will be described with reference to FIG. 2.

The ribbon cartridge 1 includes the supply bobbin 10, a take-up bobbin 20, a case 2 for housing the supply bobbin 10 and the take-up bobbin 20, and an ink ribbon (thermal transfer sheet) 3 comprising a support layer and an ink layer, provided between the supply bobbin 10 and the take-up bobbin 20. The ink ribbon 3 is mounted on the supply bobbin 10 and on the take-up bobbin 20.

The take-up bobbin 20 of the thus-constructed ribbon cartridge 1 includes a cylindrical bobbin body 21, a gear flange 22 formed integrally with the bobbin body 21 at one end of the bobbin body 21, and a support shaft 25 formed integrally with the bobbin body 21 at the other end of the bobbin body 21.

Figure 3:
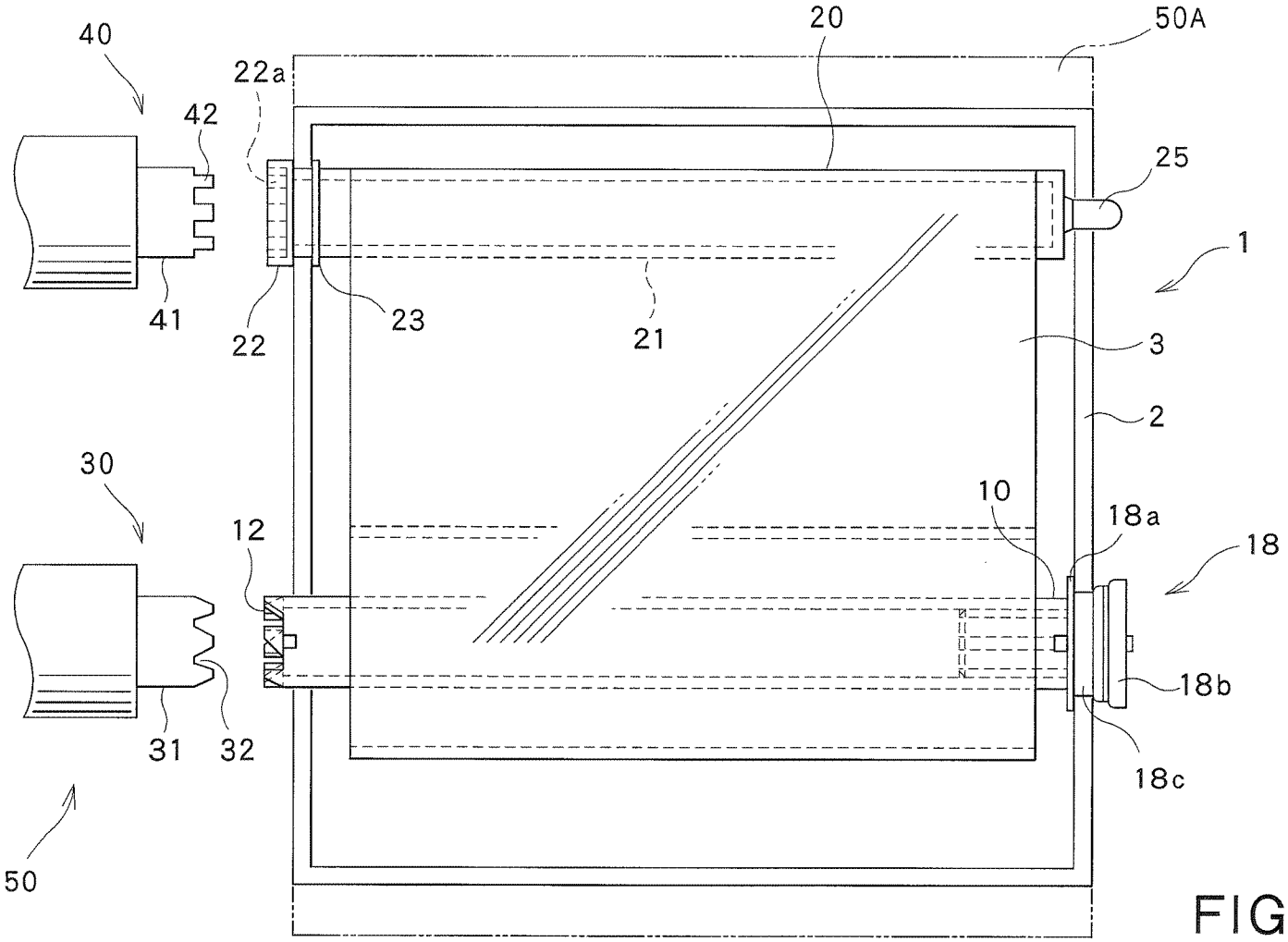
FIG. 3 is a plan view of the assembly of a sheet and bobbins set in a thermal transfer printer.
Figure 4A:
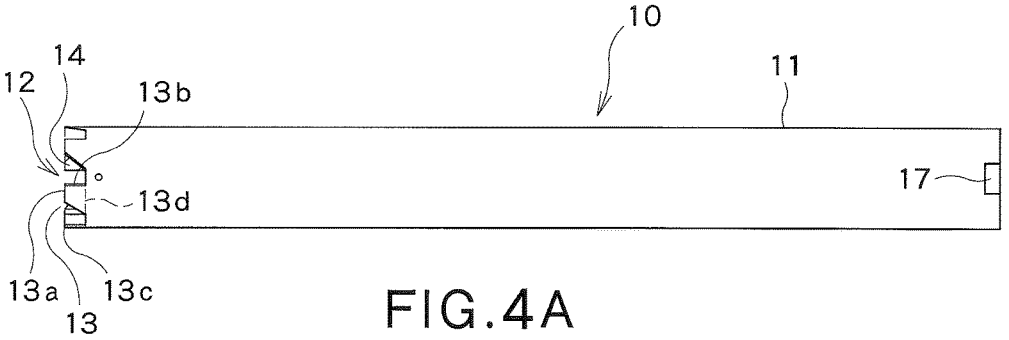
FIG. 4A is a side view of a supply bobbin.
Figure 4B:
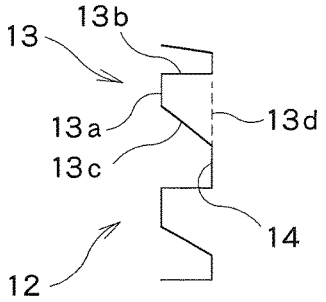
FIG. 4B is an enlarged view of the supply bobbin.
Figure 5:
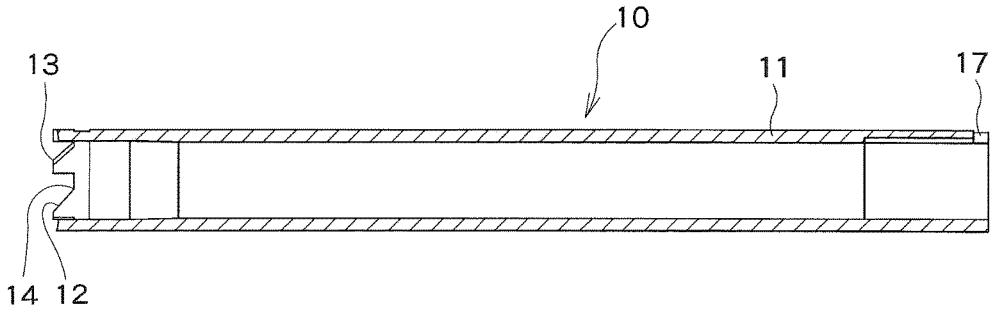
FIG. 5 is a cross-sectional side view of the supply bobbin.
Figure 6:
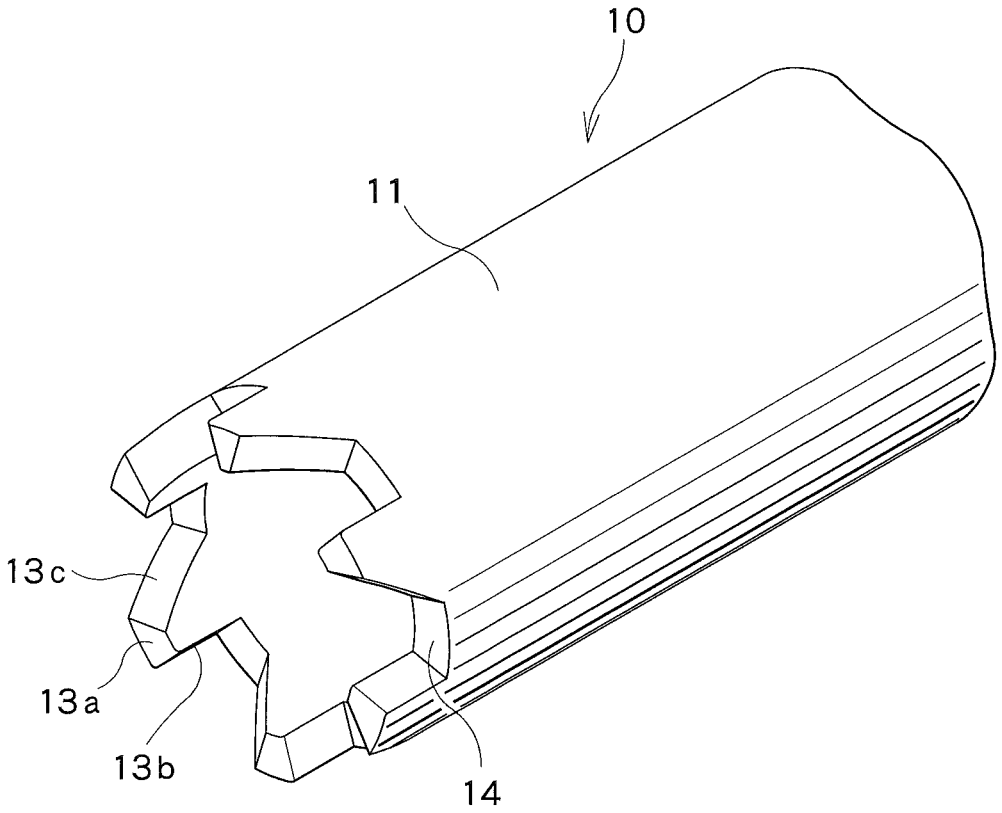
FIG. 6 is a perspective view of the supply bobbin.

The gear flange 22 has a number of teeth 22*a* formed in the inner peripheral surface. The teeth 22*a* engage a drive section 40 of a thermal transfer printer 50 so that the drive section 40 rotationally drives the take-up bobbin 20 (see FIG. 3). As shown in FIG. 3, the bobbin body 21 of the take-up bobbin 20 has a circumferential projection 23 formed in the vicinity of the gear flange 22. A portion of the bobbin body 21, lying between the gear flange 22 and the circumferential projection 23, engages the case 2, whereby the take-up bobbin 20 is positioned along the axial direction within the case 2.

The drive section 40 of the thermal transfer printer 50 includes a drive shaft 41 which, in its end surface, has a drive gear 42 that engages the teeth 22*a* of the gear flange 22.

The supply bobbin 10 (bobbin for a thermal transfer sheet or an image-receiving sheet according to the present invention) of the ribbon cartridge 1 will now be described in detail with reference to FIGS. 1 through 8. The supply bobbin 10 includes a cylindrical bobbin body 11 having a gear 12 formed in its one end surface and consisting of a number of teeth 13 and tooth grooves 14 formed between the teeth 13. As described below, the gear 12 engages a drive gear 32 of a drive shaft 31 provided in a drive section 30 of the thermal transfer printer 50.

A plurality of engagement grooves 17 are formed in the other end surface of the bobbin body 11 so that when mounting a flange portion 18 to the other end of the bobbin body 11, engagement projections 18*e* of the flange portion 18 engage the engagement grooves 17.

The supply bobbin 10 will now be described in greater detail with reference to FIGS. 4A, 4B through 8. As described above, the supply bobbin 10 includes the cylindrical bobbin body 11 having the gear 12 formed in its one end surface. The gear 12 consists of the teeth 13 and the tooth grooves 14 formed between the teeth 13. Each tooth 13 has a trapezoidal shape when viewed from the side of the bobbin body 11 (see FIGS. 4A and 4B.

Each tooth 13 has the shape of a trapezoid composed of an upper base 13*a* corresponding to a tooth top 13*a*, a lower base 13*d* extending from the tooth groove 14, and a pair of lateral sides 13*b*, 13*c* extending between the upper base 13*a* and the lower base 13*d*. The upper base 13*a* and the lateral sides 13*b*, 13*c* are each not limited to a linearly-extending one, and may be curved slightly.

The one lateral side 13*b* of each tooth 13 extends parallel to the axis of the bobbin body 11, whereas the other lateral side 13*c* is inclined with respect to the axis of the bobbin body 11.

Since the teeth 13 of the gear 12 each have a trapezoidal shape when viewed from the side of the bobbin body 11, the drive gear 32 of the drive shaft 31 can be easily engaged with the gear 12 of the supply bobbin 10 simply by pressing the drive shaft 31 of the thermal transfer printer 50 against the teeth 13 of the gear 12.

Since the one lateral side 13*b* of each tooth 13 extends parallel to the axis of the bobbin body 11, the gear 12 of the bobbin body 11 can securely engage the drive gear 32 of the drive shaft 31 without displacement as compared to the case where both of the lateral sides of each tooth 13 are inclined with respect to the axis of the bobbin body 11. If both of the lateral sides of each tooth 13 are inclined with respect to the axis of the bobbin body 11, the teeth 13 may not securely engage the teeth of the drive gear 32 when the driving force is large.

According to this embodiment, on the other hand, the one lateral side 13*b* of each tooth 13 extends parallel to the axis of the bobbin body 11. Therefore, even when a large driving force is applied from the drive shaft 31 of the thermal transfer printer 50 to the bobbin body 11, there will occur no disengagement or displacement between the teeth 13 of the gear 12 of the bobbin body 11 and the teeth of the drive gear 32.

The sum of the circumferential lengths of the tooth tops 13*a* of the teeth 13 is 20% to 70%, preferably 20% to 60% of the circumferential length of the bobbin body 11. If the sum is more than 70%, the circumferential length of each tooth groove 14 is too short for easy engagement between the gear 12 and the drive gear 32.

On the other hand, if the sum is less than 20%, it is difficult to transmit a large driving force from the drive gear 32 to the bobbin body 11. The sum is set in the above range also in view of the possibility of a user touching the gear. The term "circumferential length" herein refers to the circumferential length in terms of the outer periphery.

The thus-constructed bobbin body 11 is disposed coaxially with the drive shaft 31 of the thermal transfer printer 50 and transmits the driving force of the drive shaft 31 in the rotational direction to the bobbin body 11 via the drive gear 32 and the gear 12.

Figure 7:
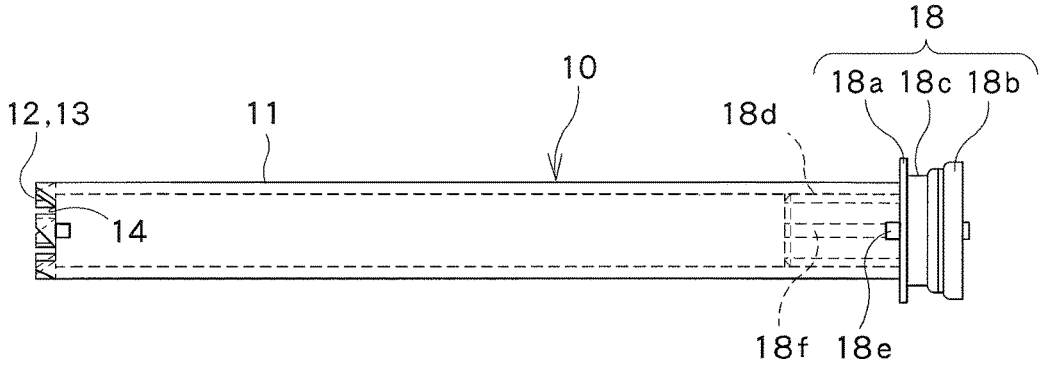
FIG. 7 is a side view of the supply bobbin having a flange portion.
Figure 8:
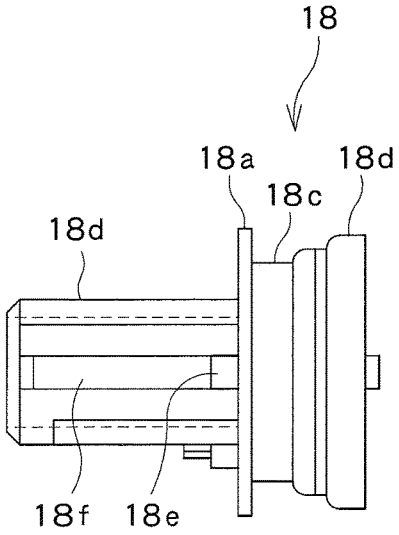
FIG. 8 is a side view of the flange portion.

The flange portion 18 to be mounted to the bobbin body 11 will now be described. As shown in FIGS. 7 and 8, the flange portion 18 is to be mounted to the other end of the bobbin body 11, and includes a first flange 18*a*, a second flange 18*b*, and an engagement portion 18*c* which is formed between the first flange 18*a* and the second flange 18*b* and engages the case 2. A cylindrical portion 18*d*, which is to be inserted into the bobbin body 11, is coupled to the first flange 18*a*.

The engagement projections 18*e*, which are to engage the engagement grooves 17 of the bobbin body 11, are provided in the cylindrical portion 18*d* of the flange portion 18 at positions adjacent to the first flange 18*a*.

The cylindrical portion 18*d* of the flange portion 18 is also provided with axial ribs 18*f* whose height is lower than the height of the engagement projections 18*e* and which extend in the axial direction. The axial ribs 18*f* of the flange portion 18 are to engage axial grooves (not shown) formed in the inner surface of the bobbin body 11.

The thus-constructed flange portion 18 is constructed as a separate member from the bobbin body 11 and mounted to the bobbin body 11. The supply bobbin 10 is thus constructed.

The flange portion 18 has a built-in RFID for identifying the type of the ink ribbon 3 to be supplied.

The operation of the thus-constructed ribbon cartridge 1 of this embodiment will now be described.

First, the supply bobbin 10 with the ink ribbon 3 wound thereon and the take-up bobbin 20 are prepared. When the ink ribbon 3 is wound on the supply bobbin 10, it is kept pressed against the supply bobbin 10 by a touch roller.

Next, the supply bobbin 10 and the take-up bobbin 20 are set in the case 2, thereby obtaining the ribbon cartridge (assembly of bobbins and a sheet) 1 including the case 2, the supply bobbin 10 with the ink ribbon 3 wound thereon, and the take-up bobbin 20.

Next, the ribbon cartridge 1 is set in a mounting section 50A of the thermal transfer printer 50. The take-up bobbin 20 of the ribbon cartridge 1 aligns coaxially with the drive shaft 41 of the drive section 40 of the thermal transfer printer 50, and the supply bobbin 10 aligns coaxially with the drive shaft 31 of the drive section 30 of the thermal transfer printer 50.

Next, the drive section 40 is pressed against the take-up bobbin 20, whereby the drive gear 42 of the drive section 40 engages the gear flange 22 (the teeth 22*a* formed in the inner peripheral surface) of the take-up bobbin 20.

Similarly, the drive section 30 is pressed against the supply bobbin 10, whereby the drive gear 32 formed in the drive shaft 31 of the drive section 30 engages the gear 12 of the supply bobbin 10.

Since the teeth 13 of the gear 12 each have a trapezoidal shape when viewed from the side, the drive gear 32 of the drive section 30 can be easily engaged with the gear 12 of the supply bobbin 10 simply by pressing the drive section 30 against the supply bobbin 10.

Next, the supply bobbin 10 is driven by the drive section 30 and the take-up bobbin 20 is driven by the drive section 40, whereby the ink ribbon 3 wound on the supply bobbin 10 is supplied. The ink ribbon 3, extending between the supply bobbin 10 and the take-up bobbin 20, is heated by a thermal head (not shown), whereby the ink of the ink ribbon 3 is transferred onto an image-receiving sheet (not shown). A thermal transfer operation is performed in this manner.

As described above, according to this embodiment, the gear 12 having the teeth 13 is formed in one end surface of the bobbin body 11 of the supply bobbin 10. By engaging the drive gear 32 of the drive section 30 of the thermal transfer printer 50 directly with the gear 12, the driving force of the drive shaft 31 of the drive section 30 in the rotational direction can be transmitted directly to the bobbin body 11.

Accordingly, there is no need to provide the bobbin body 11 with a flange that engages the drive shaft 31; thus, the number of parts can be reduced. Furthermore, there is no need to provide driving irregularities, which engage the drive shaft 31 of the drive section 30, in the outer surface of the bobbin body 11. The outer surface of the bobbin body 11 can therefore be a smooth surface. This can avoid scratching on a rubber touch roller which is used to wind the ink ribbon 3 on the supply bobbin 10.

Further, since the teeth 13 of the gear 12 each have a trapezoidal shape when viewed from the side, the drive gear 32 of the drive section 30 can be easily engaged with the gear 12 simply by pressing the drive section 30 against the gear 12.

Variations

Variations of the present invention will now be described with reference to FIGS. 9 and 10.

Though in the embodiment illustrated in FIGS. 1 through 8 the flange portion 18 is mounted to the other end of the bobbin body 11, the present invention is not limited to this feature. For example, as shown in FIG. 9, it is possible to provide a circumferential groove 28, which engages the case 2 to perform positioning of the supply bobbin 10, at the other end of the bobbin body 11.

Figure 9:
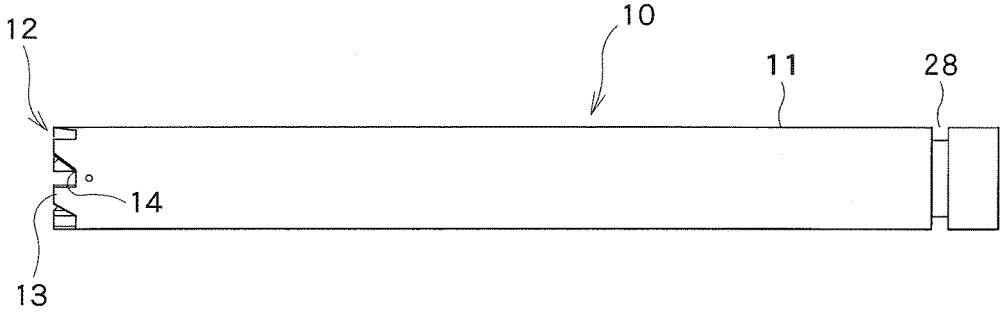
FIG. 9 is a side view of a bobbin body according to a variation of the present invention.

As shown in FIG. 9, as with the embodiment illustrated in FIGS. 1 through 8, the gear 12, consisting of the teeth 13 and the tooth grooves 14 formed between the teeth 13, is formed at the one end of the bobbin body 11.

As shown in FIG. 9, the supply bobbin 10 consists solely of the bobbin body 11 and has no flange portion; thus, the number of parts can be further reduced.

Though in the embodiment illustrated in FIGS. 1 through 8 the flange portion 18 is mounted to the other end of the bobbin body 11, the present invention is not limited to this feature. For example, as shown in FIG. 10, it is possible to provide a pair of circumferential projections 29, which engages the case 2 to perform positioning of the supply bobbin 10, at the other end of the bobbin body 11.

Figure 10:
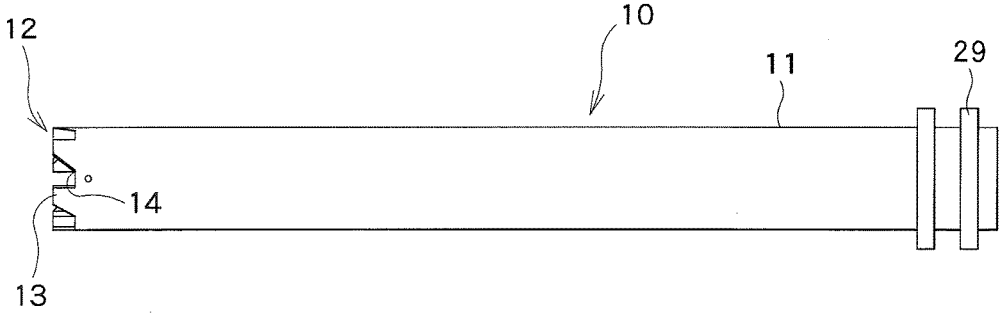
FIG. 10 is a side view of a bobbin body according to another variation of the present invention.

As shown in FIG. 10, as with the embodiment illustrated in FIGS. 1 through 8, the gear 12, consisting of the teeth 13 and the tooth grooves 14 formed between the teeth 13, is formed at the one end of the bobbin body 11.

As shown in FIG. 10, the supply bobbin 10 consists solely of the bobbin body 11 and has no flange portion; thus, the number of parts can be further reduced.

Though in the above-described embodiment the ink ribbon (thermal transfer sheet) 3 is wound on the supply bobbin 10 and on the take-up bobbin 20, it is also possible to wind an image-receiving sheet on the supply bobbin 10 and on the take-up bobbin 20. Thus, the supply bobbin 10 and the take-up bobbin 20 may be used as bobbins for an image-receiving sheet.

DESCRIPTION OF THE REFERENCE NUMERALS

1 ribbon cartridge
2 case
3 ink ribbon
10 supply bobbin
11 bobbin body
12 gear
13 tooth
13*a* tooth top
13*b*, 13*c* lateral sides
13*d* lower base
17 engagement groove
20 take-up bobbin
21 bobbin body
22 gear flange
30 drive section
31 drive shaft
32 drive gear
40 drive section
41 drive shaft
42 drive gear
50 thermal transfer printer
50A mounting section

The invention claimed is:

1. A bobbin for a thermal transfer sheet or an image-receiving sheet, comprising a cylindrical bobbin body, wherein a gear including a number of teeth is formed in one end surface of the bobbin body, wherein when the bobbin body is viewed from the side, the teeth each have the shape of a trapezoid composed of an upper base, a lower base, and a pair of lateral sides, one of the lateral sides extending parallel to the axis of the bobbin body, and wherein a sum of circumferential lengths of tooth tops of the teeth is 20% to 70% of a circumferential length of the bobbin body.

2. The bobbin for a thermal transfer sheet or an image-receiving sheet according to claim 1, wherein the bobbin body is provided with a circumferential groove or a circumferential projection which performs positioning of the bobbin body when setting it in a case.

3. The bobbin for a thermal transfer sheet or an image-receiving sheet according to claim 2, wherein the bobbin body is provided, in the other end surface, with an engagement groove which performs positioning of a flange when mounting it to the bobbin body.

4. The bobbin for a thermal transfer sheet or an image-receiving sheet according to claim 1, wherein the bobbin body is provided, in the other end surface, with an engagement groove which performs positioning of a flange when mounting it to the bobbin body.

5. An assembly of a bobbin and a sheet, comprising: the bobbin for a thermal transfer sheet or an image-receiving sheet according to claim 1; and a thermal transfer sheet or an image-receiving sheet wound on the bobbin.

6. The assembly of a bobbin and a sheet according to claim 5, further comprising a case for housing the bobbin and the thermal transfer sheet or the image-receiving sheet.

7. A thermal transfer printer incorporating the assembly of a bobbin and a sheet according to claim 5, comprising: a mounting section in which the assembly of a bobbin and a sheet is to be set; and a drive section including a drive shaft extending coaxially with the bobbin body, wherein a drive gear that engages the gear of the bobbin body is provided in an end surface of the drive shaft.

* * * * *